US006441735B1

(12) United States Patent
Marko et al.

(10) Patent No.: US 6,441,735 B1
(45) Date of Patent: Aug. 27, 2002

(54) LOCK SENSOR DETECTION SYSTEM

(75) Inventors: Matthew P. Marko, Bloomfield Hills; Adam J. Kollin, Rochester Hills, both of MI (US)

(73) Assignee: Marlin Security Systems, Inc., Bloomfield Hills, MI (US)

( * ) Notice: Subject to any disclaimer, the term of this patent is extended or adjusted under 35 U.S.C. 154(b) by 0 days.

(21) Appl. No.: 09/789,693

(22) Filed: Feb. 21, 2001

(51) Int. Cl.[7] ..... E05B 45/06

(52) U.S. Cl. ..... 340/542; 340/547; 340/551; 70/276; 70/432

(58) Field of Search ..... 340/542, 545.1, 340/547, 551; 70/57.1, 77, 81, 91, 99, 104, 106, 111, 116, 179, 176, 432, 433, 434, 273; 200/61.27, 61.45 M

(56) References Cited

U.S. PATENT DOCUMENTS

| | | | | |
|---|---|---|---|---|
| 587,591 | A | 8/1897 | Lurye et al. | 70/441 |
| 640,276 | A | 1/1900 | Dallimore | 346/14 R |
| 1,112,419 | A | 9/1914 | Phelps | 70/433 |
| 1,317,321 | A | 9/1919 | Ryberg | 70/434 |
| 1,546,509 | A | 7/1925 | Poole | 200/506 |
| 1,832,540 | A | 11/1931 | Fairchild | 70/252 |
| 2,101,058 | A | 12/1937 | Goldstone | 340/542 |
| 2,103,363 | A | 12/1937 | Hansen | 70/264 |
| 2,623,959 | A | 12/1952 | Jarrett | 200/43.04 |
| 2,634,598 | A | 4/1953 | Kaiser | 70/472 |
| 3,000,687 | A | 9/1961 | Haupt | 346/7 |
| 3,093,994 | A | 6/1963 | Richard | 70/434 |
| 3,392,558 | A | 7/1968 | Hedin et al. | 361/172 |
| 3,427,835 | A | 2/1969 | Jeffee | 70/432 |
| 3,537,094 | A | 10/1970 | Hawkins et al. | 340/521 |
| 3,643,249 | A | 2/1972 | Haywood | 340/542 |
| 3,685,036 | A | 8/1972 | Torok | 340/542 |
| 3,791,180 | A | 2/1974 | Doyle | 70/107 |
| 3,803,575 | A | 4/1974 | Gotanda | 340/522 |
| 3,830,085 | A | 8/1974 | Gerlach | 70/35 |
| 3,890,608 | A | 6/1975 | Peterson | 340/522 |
| 3,922,896 | A | 12/1975 | Kagoura | 70/223 |
| 3,939,315 | A | 2/1976 | Schlage | 200/61.64 |
| 3,962,695 | A | 6/1976 | Peters | 340/542 |
| 3,967,481 | A | 7/1976 | Schlage | 70/431 |
| 4,035,791 | A | 7/1977 | Katayama | 340/522 |
| 4,062,314 | A | 12/1977 | Allen et al. | 116/85 |
| 4,078,405 | A | 3/1978 | Steinbach | 70/491 |
| 4,100,774 | A | 7/1978 | Solovieff et al. | 70/380 |
| 4,143,897 | A | 3/1979 | Bergen | 292/347 |
| 4,148,202 | A | 4/1979 | Wegrzyn | 70/431 |
| 4,178,587 | A | 12/1979 | Jamison | 340/542 |
| 4,205,542 | A | 6/1980 | Renda | 70/434 |
| 4,227,386 | A | 10/1980 | Crockett | 70/118 |
| 4,376,379 | A * | 3/1983 | Gotanda | 70/118 |
| 4,427,224 | A | 1/1984 | Bergen | 292/1.5 |
| 4,438,430 | A | 3/1984 | Young et al. | 340/547 |
| 4,453,390 | A | 6/1984 | Moritz et al. | 70/434 |
| 4,465,997 | A | 8/1984 | Hines | 340/542 |
| 4,516,114 | A | 5/1985 | Cook | 340/542 |
| 4,516,798 | A | 5/1985 | Bergen | 292/169.13 |

(List continued on next page.)

*Primary Examiner*—Daniel J. Wu
*Assistant Examiner*—Toan Pham
(74) *Attorney, Agent, or Firm*—Harness, Dickey & Pierce, P.L.C.

(57) ABSTRACT

Apparatus for providing a signal in response to the actuation of an internal lock mechanism for a door latch to a locked condition of the door latch and for detecting the locked condition when the door is in a closed position with the door latch bolt in the door jamb. Detection apparatus is located in the door jamb and senses the lock signal and in turn can provide a signal locally or to a remote security or surveillance system indicating the locked or unlocked condition of the latch bolt when the door is in the closed position.

17 Claims, 8 Drawing Sheets

OTHER PUBLICATIONS

| | | | | | |
|---|---|---|---|---|---|
| 4,559,796 | A | | 12/1985 | De Forrest, Sr. | 70/432 |
| 4,565,994 | A | | 1/1986 | Mochida et al. | 340/542 |
| 4,631,944 | A | | 12/1986 | Gater et al. | 70/472 |
| 4,672,829 | A | | 6/1987 | Gater et al. | 70/472 |
| 4,679,031 | A | | 7/1987 | Hwang | 340/501 |
| 4,683,741 | A | | 8/1987 | Fields | 70/432 |
| 4,717,909 | A | | 1/1988 | Davis | 340/686.1 |
| 4,760,380 | A | | 7/1988 | Quenneville et al. | 340/542 |
| 4,763,937 | A | * | 8/1988 | Sittnick, Jr. et al. | 292/251.5 |
| 4,772,877 | A | | 9/1988 | Rice et al. | 340/543 |
| 4,806,910 | A | | 2/1989 | Salzer | 340/547 |
| 4,814,557 | A | | 3/1989 | Kato | 200/61.64 |
| 4,818,971 | A | | 4/1989 | Patrick | 340/543 |
| 4,844,522 | A | | 7/1989 | Pechar | 292/169 |
| 4,845,471 | A | | 7/1989 | Chu | 340/542 |
| 5,025,426 | A | | 6/1991 | Blumberg et al. | 368/10 |
| 5,062,670 | A | | 11/1991 | Grossman | 292/137 |
| 5,164,705 | A | | 11/1992 | Dunagan et al. | 340/547 |
| 5,311,168 | A | | 5/1994 | Pease, Jr. et al. | 340/542 |
| 5,364,139 | A | | 11/1994 | Bergen et al. | 292/169 |
| 5,486,812 | A | | 1/1996 | Todd | 340/539 |
| 5,539,378 | A | | 7/1996 | Chang | 340/542 |
| 5,608,298 | A | * | 3/1997 | Frolov et al. | 318/286 |
| 5,680,095 | A | | 10/1997 | Nassouri | 340/426 |
| 5,712,626 | A | * | 1/1998 | Andreou et al. | 340/825.31 |
| 5,862,691 | A | | 1/1999 | Friedrich et al. | 70/264 |
| 5,925,861 | A | | 7/1999 | Fromberg | 200/61.67 |
| 6,022,056 | A | * | 2/2000 | Cope et al. | 292/144 |
| 6,225,903 | B1 | * | 5/2001 | Soloway et al. | 340/542 |

* cited by examiner

LOCK SENSOR DETECTION SYSTEM

FIELD OF THE INVENTION

The present invention relates to sensor systems for detecting the locked or unlocked condition primarily for openings such as doors for homes and buildings.

BACKGROUND OF THE INVENTION

It is well established to provide means to detect the locked or unlocked condition of a door and to transmit a signal indicative of this condition to a central or local alarm or surveillance system. With doors such sensing is commonly done by detection of the position of a dead bolt. Many conventional locks for doors, however, do not utilize dead bolts for locking but instead provide locking by an internal lock of the door latch bolt or door knob. In the present invention a simple system is provided in which a signal is generated upon actuation of the lock for the latch bolt. At the same time, however, detection apparatus is provided in the door jamb in the door frame such that the locked condition is sensed only when the door is closed and the latch bolt is located in the door jamb. Now the signal can be readily transmitted to a central alarm or surveillance system or a local display whereby an indication will be provided of the locked or unlocked condition of the latch bolt and hence of the door when the latch bolt is engaged in the door jamb.

The apparatus of the present invention being of a relatively simple construction can be made to readily replace existing door latch assemblies as a retrofit. In addition it can be applied to some existing door latch assembly designs.

SUMMARY OF THE INVENTION

In one form of the present invention, the signal generating and detecting apparatus utilizes a permanent magnet which is pivotally mounted in a door latch assembly within the door. Upon actuation of the lock for the latch bolt the magnet is pivoted into alignment with a magnetic circuit that extends through the latch bolt. A detector, such as a reed switch, is located in that part of the magnetic circuit in the door jamb and will sense the presence and locked condition of the latch bolt when the magnetic field is energized by the pivotal location of the magnet into the magnetic circuit in response to actuation of the lock.

In a preferred form of the invention, magnetic signal generating detection apparatus is used in a compact construction readily adaptable for a conventional door latch assembly. However, as will be seen other forms of non-contact signal generating and detecting apparatus may be used.

Thus it is an object of the present invention to provide a contactless detection system for a door latch assembly for detecting and providing a signal upon closure of a door and placing the latch bolt in a locked condition.

It is another object of the present invention to provide a contactless detection system utilizing a magnetically actuated circuit for detecting and providing a signal upon closure of a door and placing the latch bolt in a locked condition.

It is still another object of the present invention to provide a contactless detection system adaptable for use with door latch assembly designs of generally conventional constructions and for detecting and providing a signal upon closure of a door and placing the latch bolt in a locked condition.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood and apparent from the detailed description and the appended claims, taken in conjunction with the accompanying drawings, in which:

DETAILED DESCRIPTION OF THE PREFERRED EMBODIMENTS

Looking now to the drawings, it can be seen that the basic construction of the door latch assembly is of one well known in the art. As will be seen, however, the present invention provides a unique lock sensor detection system for use in general with basic door latch assemblies with relatively minor changes. In this regard the door latch assembly shown by way of example, has the basic construction of a form made by D.S. & A. Inc. and sold under Part No. 51073 and except for the changes as described is of that basic construction. A similar unit is made and sold by Kwikset Corporation.

Figure 1:
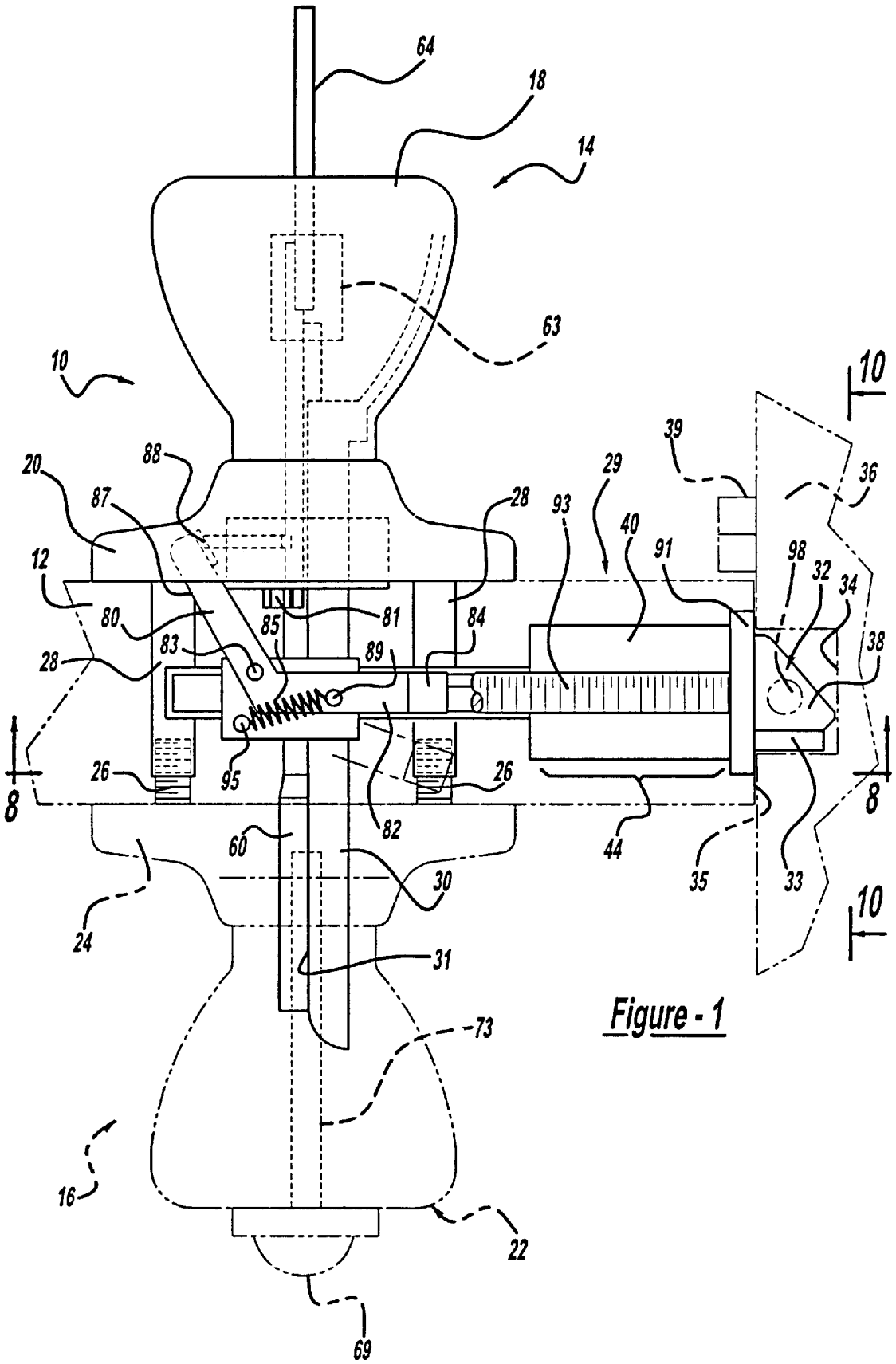
FIG. 1 is a top elevational view of a generally conventional door latch assembly modified to include the lock sensor alarm system of the present invention with some parts shown in section and others shown broken away and with a reed switch shown in phantom and includes a pair of door knob subassemblies with a key lock actuated door knob subassembly shown on one side and a non-key, ribbed pivot button lock actuated subassembly shown in phantom on the opposite side.
Figure 2:
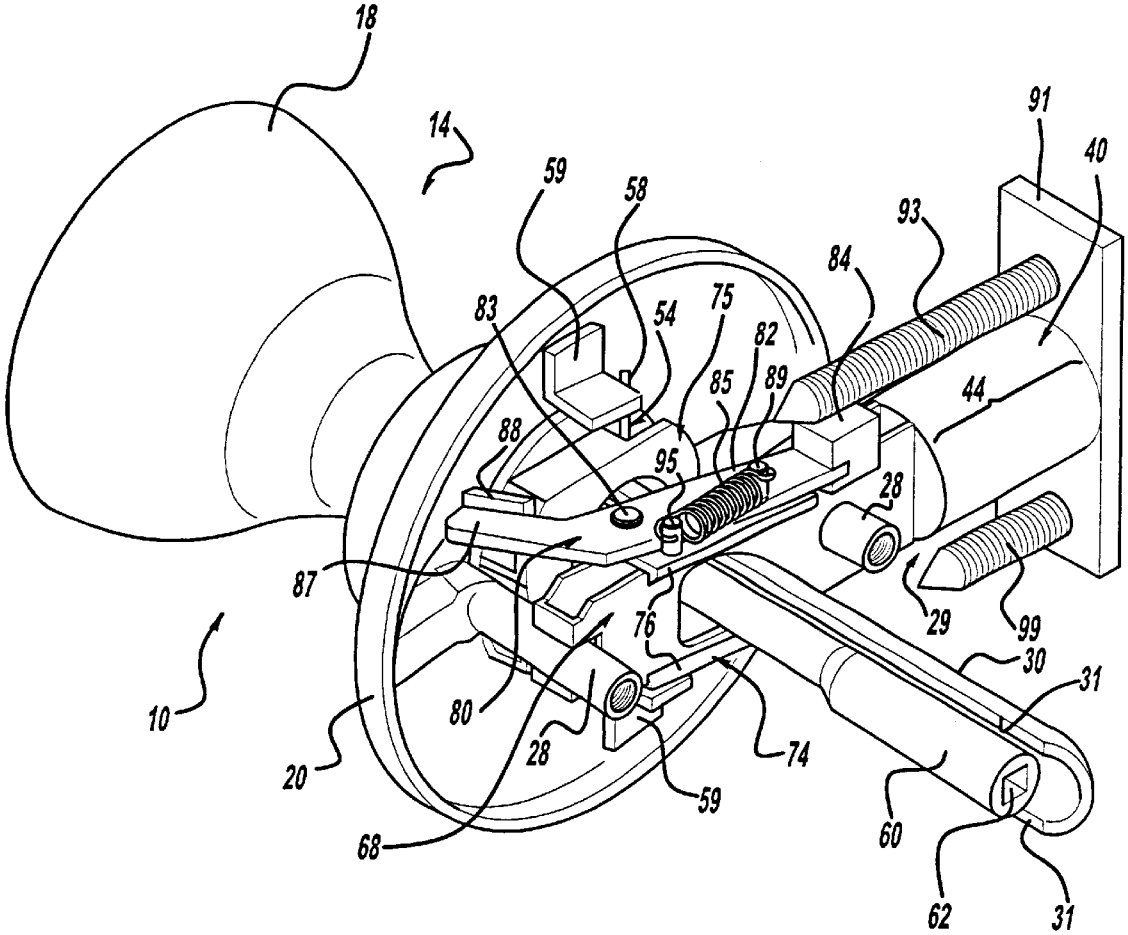
FIG. 2 is a perspective view of the door latch assembly of FIG. 1 showing only the key actuated door knob subassembly.

In FIG. 1, the door latch assembly 10 is shown mounted to a door 12 (shown in phantom) and includes a first door knob subassembly 14 mounted on one side of the door 12 and a second door knob subassembly 16 (shown in phantom) mounted on the opposite side of the door 12. The first door knob subassembly 14 includes a rotatable door knob 18 mounted to the door 12 by connection with a generally circular face plate 20. Similarly, the second door knob subassembly 16 includes a rotatable door knob 22 mounted to the door 12 by connection with a second generally circular face plate 24. In this regard, the first and second knob subassemblies 14 and 16 are held to the door 12 in operative alignment with each other by means of the interconnection of two threaded bolts 26 extending through face plate 24 and being threadably engaged with two internally threaded studs 28 connected to the face plate 20. The face plates 20 and 24 are formed with relatively shallow cavities on their inner sides.

Looking now to FIGS. 1–3 and 8, a semicircularly shaped rotator shaft 30 is rotatably connected to the first knob 18 and extends through the door 12 and into rotatable engagement with the second knob 22. In this way rotation of either door knob 18, 22 will rotate the other by way of the rotator shaft 30. As will be seen the diametrically opposite edges 31 of the rotator shaft 30 are used for engagement with driving components with the door knobs 18, 22 and also with selectively actuable locking components, to be described, whereby rotation of door knobs 18, 22 will be prevented when the door latch assembly 10 is placed in its locked condition.

A latch assembly 29 includes an elongated latch bolt 32 supported in a housing subassembly 40. Either of the door knob subassemblies 14 and 16 are mounted for driving a latch assembly generally indicated at 29 within the door 12 to move a latch bolt generally indicated at 32 and an anti-tamper rod generally indicated at 33 from extended to retracted and from retracted to extended positions at a door edge generally indicated at 35, again, all in a usual manner. The anti-tamper rod 33 is resiliently movable relative to the latch bolt 32 to inhibit tampering with the latch bolt 32 from outside of the door 12. As pointed out, the principles of the present invention relate to a lock sensor detection system so that the door knob subassemblies 14 and 16, and the latch assembly 29 including the latch bolt 32 and anti-tamper rod 33 may generally be of conventional constructions adaptable for satisfying the interaction of the combinations but with modifications for the sensing operation to be described and thus certain details thereof have been omitted for purposes of simplicity and brevity.

Figure 3:
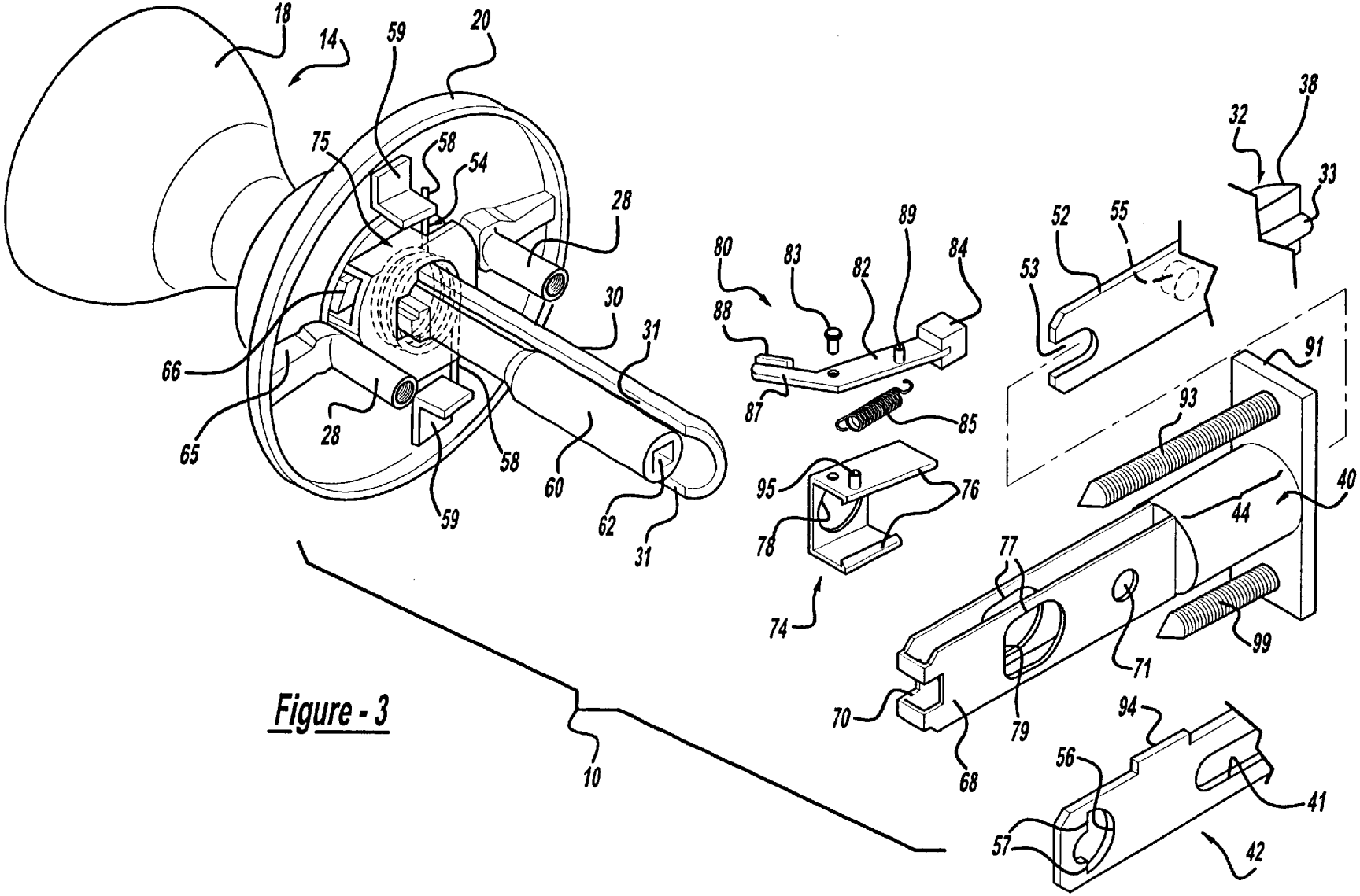
FIG. 3 is an exploded perspective view of the portion of the door latch assembly of FIG. 2.

The latch bolt 32 has a nose portion 38 adapted to be movably located in an opening 34 in a door jamb 36 whereby the door 12 can be opened or closed. In this regard the outer nose portion 38 is tapered on one side to facilitate closure from one side and is substantially flat on the opposite side to block opening of the door 12 by pushing in that direction when located in the door jamb opening 34. In this regard a molding 39 is fixed to the wall of the door jamb 36 in a position to engage the door 12 on the tapered side of the nose portion 38 to prevent excessive movement of the door 12 in that direction after the nose portion 38 is located in the door jamb opening 34. As can be seen in FIGS. 1 and 3 the latch bolt 32 is supported in housing subassembly 40 with the nose portion 38 operatively connected to an inwardly extending, generally flat extension plate 52 which in turn is movably connected to a generally flat drive plate 42. The anti-tamper rod 33 is of a conventional construction noted and does not interact with the lock sensor detection system and hence the details thereof have been omitted.

The housing subassembly 40 includes a generally cylindrical housing section 44 in which the latch bolt 32 is slidably supported. The drive plate 42 has an elongated center opening or slot 41 to provide clearance with the outer one of the threaded studs 28. The extension plate 52 of the latch bolt 32 is attached to the inner end of the latch bolt nose portion 38 and extends axially inwardly therefrom and into the housing section 44. At the same time the extension plate 52 has a stud 55 which extends transversely into the slot 41 whereby the extension plate 52 and hence latch bolt 32 will be moved to the retracted position by inward movement of the drive plate 42. The latch bolt 32 is normally resiliently biased with its nose portion 38 extending outwardly by a spring (not shown) inside of the cylindrical housing section 44 to bias it outwardly. In this regard the connection of the drive plate 42 to the latch bolt extension plate 52 by engagement of the stud 55 in the slot 41 provides a lost motion type connection which permits the latch bolt 32 to be moved inwardly, independently of movement of the drive plate 42, to its retracted position against the bias of the spring. In this regard, the extension plate 52 has an open slot 53 at its inner end to provide clearance with the outer stud 28 when in the retracted position. Thus the nose portion 38 is resiliently movable inwardly relative to the drive plate 42 to facilitate closure of the door 12 without need to actuate the door knob subassemblies 14 or 16. The drive plate 42 has a generally semi-circular opening 56 which receives in mating engagement the semi-circular contour of the rotator shaft 30 with engaging contact of the edges 31 with the flat ends 57 of the semi-circular opening 56. Thus rotation of the rotator shaft 30 in a clockwise or counterclockwise direction by either door knob 18 or 22 will result in rearward movement of the drive plate 42 causing retraction of the latch bolt 32 and movement of the nose portion 38 out from the door jamb opening 34 whereby the door 12 can be opened. At the same time the rotator shaft 30 and hence the drive plate 42 are normally biased by a coil spring 54 to their neutral, non-actuated positions to permit the latch bolt 32 with its nose portion 38 to be resiliently maintained in its normally outwardly extended position from the cylindrical housing section 44 for closure. End arms 58 extend radially oppositely from the body of the coil spring 54 to engage stop brackets 59 secured to the face plate 20 within its cavity.

The door latch assembly 10 is adapted to be locked by a key 64 applied through a key hole in the door knob 18 (keyhole not shown). Here the key 64, upon insertion into the key hole, will be in operative engagement with a lock shaft 60. The lock shaft 60 is of a tubular construction and has a generally square shaped engagement opening 62. A key actuated connector 63 is matably connected to the adjacent end of the lock shaft 60 and is adapted to be rotated by rotation of the key 64 to selectively rotate the lock shaft 60 to a locked or unlocked position. At the same time the opposite door knob subassembly 16 has a rotatable ribbed pivot button 69 in the door knob 22 which is connected to the opening 62 at the opposite end by a mating lock shaft 73. Thus the lock apparatus can be actuated from either side of the door 12. However, it should be noted that the key actuated door knob subassembly 14 will be located on the outer side of the door 12 while the pivot button actuated door knob subassembly 16 will be on the inner side of the door 12. It should again be noted that the actuating connection between the door knob subassemblies 14 and 16, the latch bolt 32 and the lock apparatus can be of a conventional structure well known in the art, such as in the Part No. 51073 previously noted. Thus since the specific details of such actuating connection and lock apparatus do not constitute a part of the present invention such details have been omitted with the actuating connection and lock apparatus shown mainly generally for purposes of brevity and simplicity.

Figure 4:
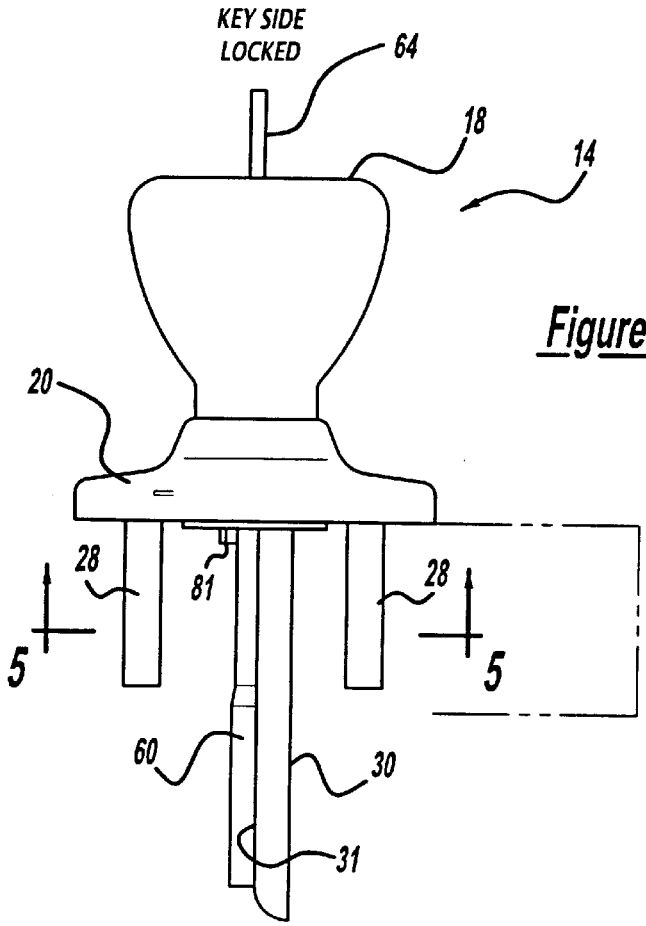
FIG. 4 is a top elevational view of the key lock actuated door knob subassembly of FIG. 1 in the locked condition.
Figure 5:
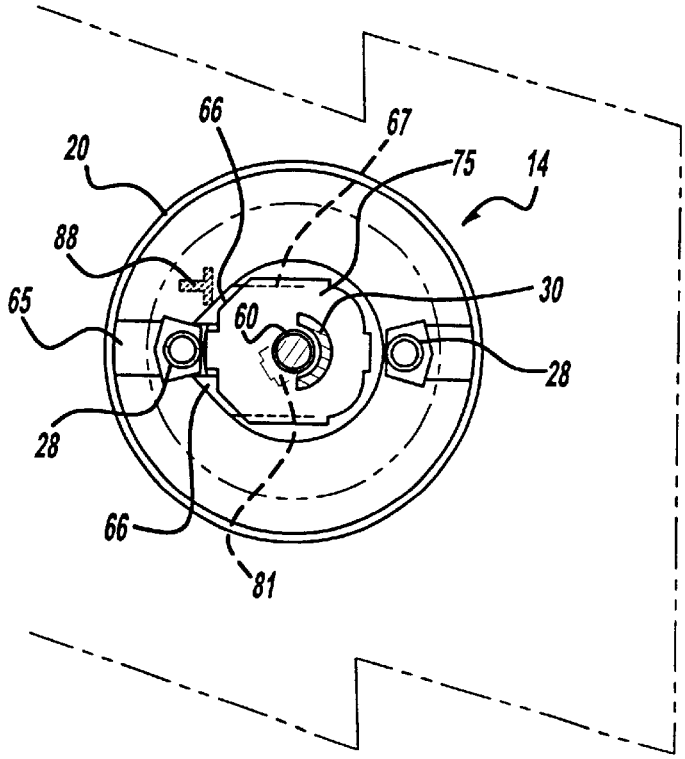
FIG. 5 is a sectional view of the door knob subassembly of FIG. 4 taken along the lines 5—5 in FIG. 4 and showing the lock in the actuated locked condition with a sensor actuating pivot plate shown in phantom in its locked sensing position.
Figure 11:
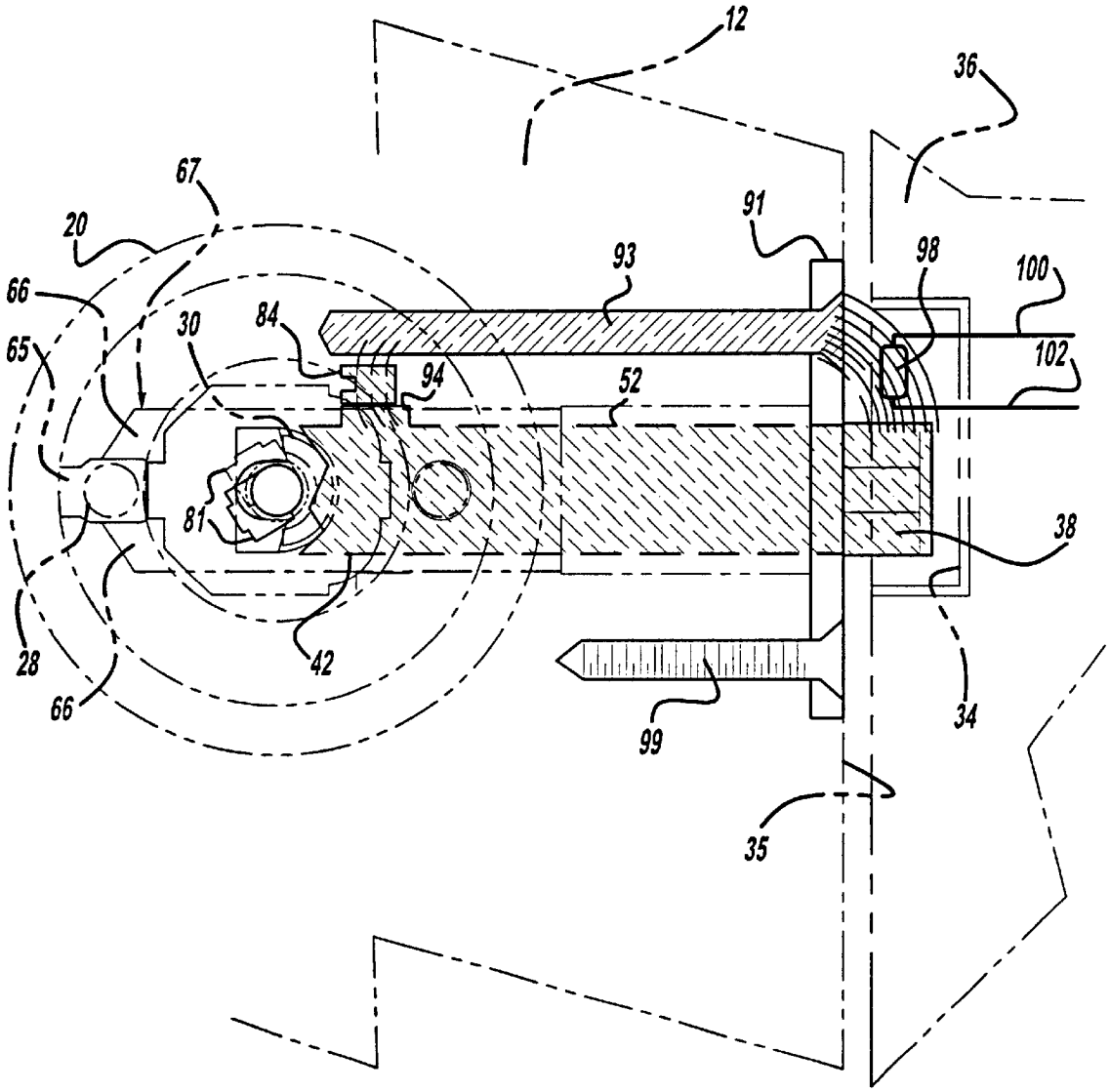
FIG. 11 is a side elevational view of the door latch assembly similar to FIG. 8 showing the key actuated door knob apparatus in the closed and locked condition with the magnetic detection apparatus in the locked condition and with the magnetic circuit shown in shaded lines and with the related elements of the door latch assembly shown in phantom lines.

In the locked condition the rotator shaft 30 will be blocked from rotation. Looking now to FIGS. 4 and 5, this occurs by radially outward movement of a pair of locking tabs 66 by rotation of the lock shaft 60 by the key 64 or pivot button 69. The locking tabs 66 will be moved radially outwardly to opposite sides of the axially innermost end of the base 65 of the inner stud 28. The locking tabs 66 are part of a slidable lock plate 67 which is rotatably supported in a drive housing assembly 75. The lock plate 67, however, is connected to the lock shaft 60 by a cam type engagement member 81 whereby rotation of the lock shaft 60 by key 64 or pivot button 69 will move the lock plate 67 with the locking tabs 66 in translation radially outwardly to a locked condition or radially inwardly to an unlocked condition. In FIG. 11 the cam engagement member 81 is shown in the locked condition with the unlocked condition shown in phantom lines. The drive housing assembly 75 in turn is in rotatable engagement with the edges 31 of the rotator shaft 30. Thus the lock plate 67 will also be rotated by the rotator shaft 30. However, when the lock plate 67 is actuated to move the locking tabs 66 into locked engagement with the base 65 of the stud 28, rotational movement of the drive housing assembly 75 and hence of the rotator shaft 30 is prevented thereby locking the latch bolt 32 from actuation by the door knobs 18 and 22. It should be noted that the opposite door knob 22 could be provided with a similar keyhole and connection to a key actuated rod whereby the door latch assembly 10 can be key locked or unlocked from either side of the door 12. Such construction is well known in the art and hence is not shown.

The housing subassembly 40 includes a generally Ush-aped channel section 68 which is attached at its open end to the inner end of the cylindrical housing section 44. The channel section 68 has a slot 70 at its closed end and a through bore 71 spaced from its open end both of which are adapted to receive the studs 28 to facilitate alignment and support of the housing subassembly 40 with the knob subassemblies 14 and 16. At the same time the channel section 68 has enlarged, generally semi-circular, in line through openings 77 to receive in clearance relationship the rotator shaft 30 and lock shaft 60. In this regard the openings 77 terminate in generally flat edges 79 which are engaged by the edges 31 of the rotator shaft 30 at the end of full rotation to provide a stop when the latch bolt 32 has been fully withdrawn from the door jamb opening 34.

Again, as noted, the above described construction is well known in the art and hence specific details thereof have been omitted for purposes of brevity and simplicity. In this regard as noted, the present invention is directed to a contactless detection system for detecting the locked or unlocked condition of the door latch assembly and also to facilitate use of such detection in a central or local alarm or surveillance system.

Looking now to FIG. 3, the magnetic detection apparatus as shown includes a support plate 74 which is of a generally C-channel section and has a pair of flanges 76 at its open side adapted to hold the plate 74 onto the channel section 68 for selective slidable movement. The support plate 74 can thus be selectively and readily moved to the desired position by the sliding engagement. See FIGS. 2 and 8. The support plate 74 has a central bore 78 adapted to receive the rotator shaft 30 and the lock shaft 60 in clearance relationship. An actuating arm 80 has a magnet carrier arm portion 82 and an engagement arm portion 87 extending angularly from the carrier arm portion 82. The actuating arm 80 is pivotally secured by a fastener 83 to the upper surface of the support plate 74 at the juncture of the carrier arm portion 82 and engagement arm portion 87. A permanent magnet 84 is secured to the outer end of the magnet carrier arm portion 82 by means of its location in a central slot in the magnet 84. The magnet 84 is polarized with its north pole (N) on its upper surface and its south pole (S) on its lower surface. See FIG. 9. As noted the magnet carrier arm portion 82 is angulated relative to the engagement arm portion 87 such as to locate the magnet carrier arm portion 82 and hence magnet 84 in the desired actuated and deactuated positions to be described. In this regard, a coil spring 85 is connected from a stud 89 on the carrier arm portion 82 to a stud 95 at the corner on the top of the support plate 74. The connecting studs 89 and 95 are selectively angularly offset from each other such that the spring 85 will normally bias the actuating arm 80 and hence the magnet carrier arm portion 82 and magnet 84 to the deactuated position.

Figure 6:
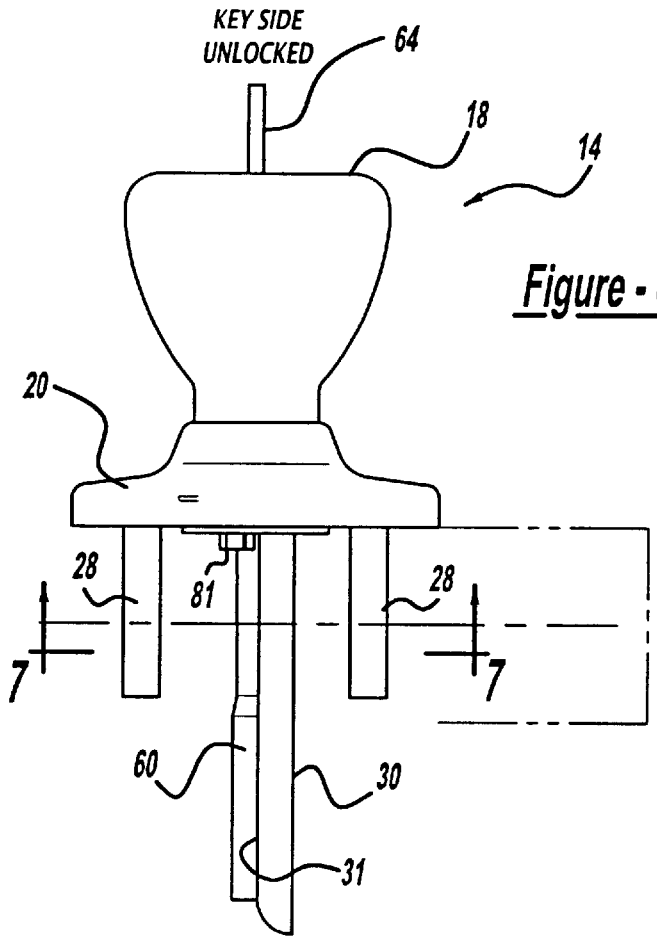
FIG. 6 is a top elevational view similar to FIG. 4 with the key lock deactuated to the unlocked condition with the sensor actuating pivot plate shown in phantom in its unlocked sensing position.
Figure 7:
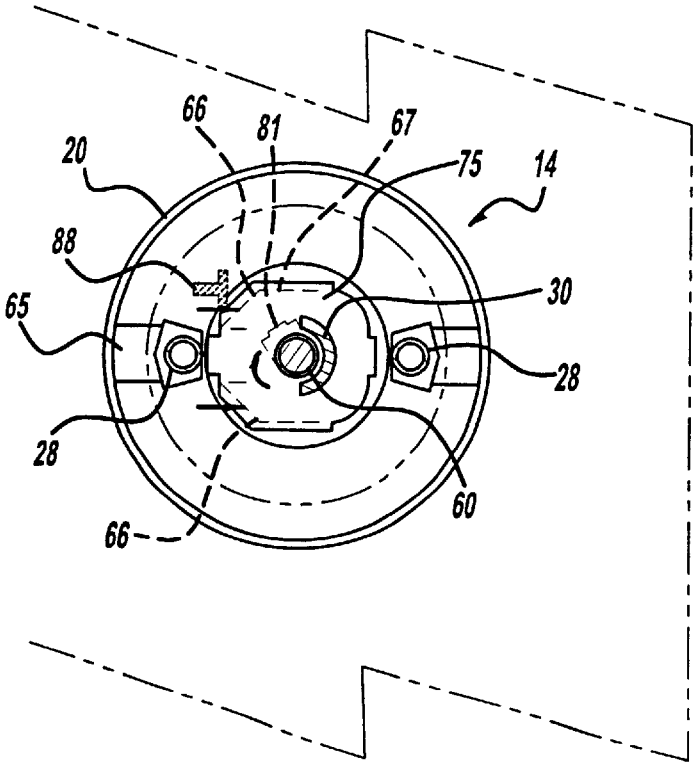
FIG. 7 is a sectional view taken along the lines 7—7 in FIG. 6 and showing the lock in the deactuated condition.

As biased, the engagement arm portion 87 extends axially towards the face plate 20 and has a pivot plate 88 connected at its inner end which plate 88 is located in line with one of the locking tabs 66. See FIGS. 5 and 7. Now when the lock shaft 60 is key actuated to the locking position it moves the lock plate 67 and hence tabs 66 radially outwardly with the one tab 66 moving into engagement with the pivot plate 88. This overcomes the bias of the spring 85 and moves the pivot plate 88 outwardly causing the actuating arm 80 to pivot the magnet carrier arm portion 82 and magnet 84 to the actuated position in a magnetic detection circuit. See FIGS. 4 and 5. Of course, upon actuation of the lock shaft 60 to the unlocked position the tabs 66 will be retracted and the spring 85 will return the magnet carrier arm portion 82 and magnet 84 to the deactuated position. See FIGS. 6 and 7.

The magnetic detection circuit includes the upper connecting bolt 93 which is adapted to engage an outer face plate 91 with the lower connecting bolt 99 similarly engaged with the face plate 91 to mount the latch assembly 29 to the door 12. The upper connecting bolt 93 is also a magnetic conductor. The face plate 91 is generally rectangular in contour and of a generally known construction for fitting into the opening in the edge of the door 12 to support the latch assembly 29 including the latch bolt 32 and its housing subassembly 40. The inner end of the connecting bolt 93 is selected to extend inwardly sufficiently to be proximate to and overlay the upper or north pole surface of the magnet 84 when it is pivoted to its actuated position in response to locking action. An elongated ridge 94 is located on the upper end of the drive plate 42 to be proximate to the lower or south pole surface of the magnet 84 when in its actuated position. This spaces the remainder of the upper end of the drive plate 42 farther from the upper connecting bolt 93 and thereby assists in optimizing the flow of magnetic flux in the desired path of the magnetic circuit. At the same time the drive plate 42 is located in close proximity or sliding engagement with the extension plate 52. As will be seen this provides for a low reluctance magnetic connection between the drive plate 42 and extension plate 52 and hence with the latch bolt nose portion 38.

The drive plate 42, latch bolt 32 including nose portion 38 and extension plate 52 and connecting bolt 93 are constructed of materials of a generally high magnetic permeability or low magnetic reluctance. In contrast the adjacent members including the face plate 91 are constructed of materials having a low magnetic permeability or high reluctance to inhibit diversion of the magnetic field. Thus the noted components provide a defined magnetic path for the magnet 84 when in its actuated position for lock detection.

Figure 8:
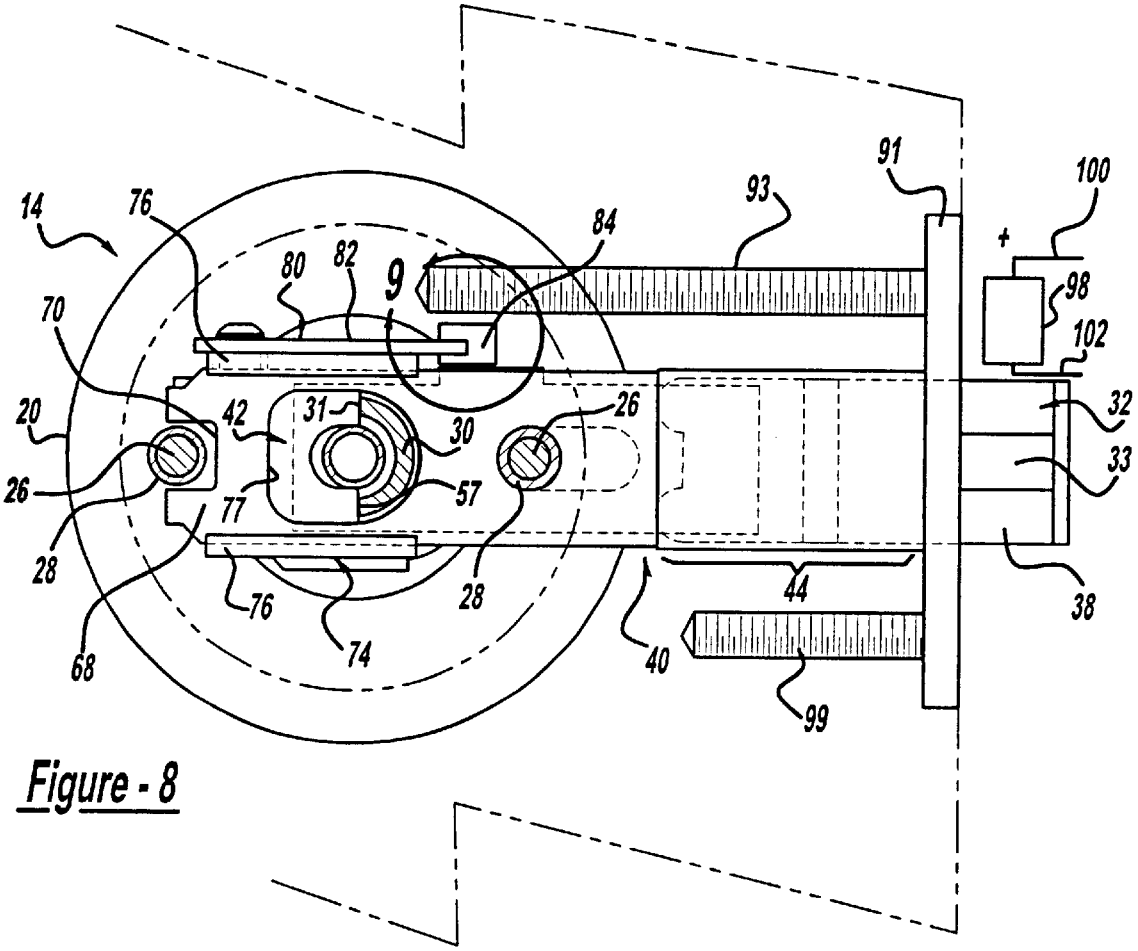
FIG. 8 is a side elevational view of the door latch assembly of FIG. 1 taken generally along the lines 8—8 in FIG. 1 and with some elements shown in section.
Figure 9:
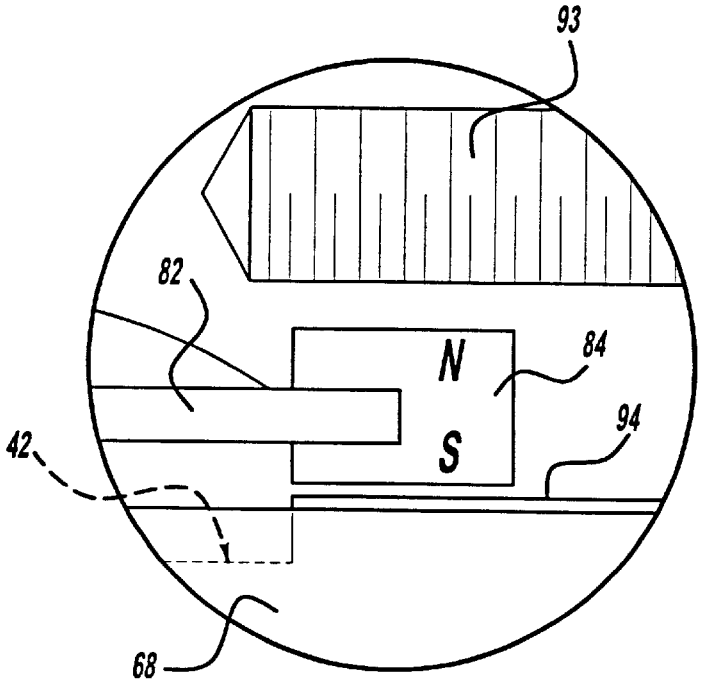
FIG. 9 is an enlarged, fragmentary elevational view taken in the Circle 9 in FIG. 8 and depicting a part of the magnetic actuator.
Figure 10:
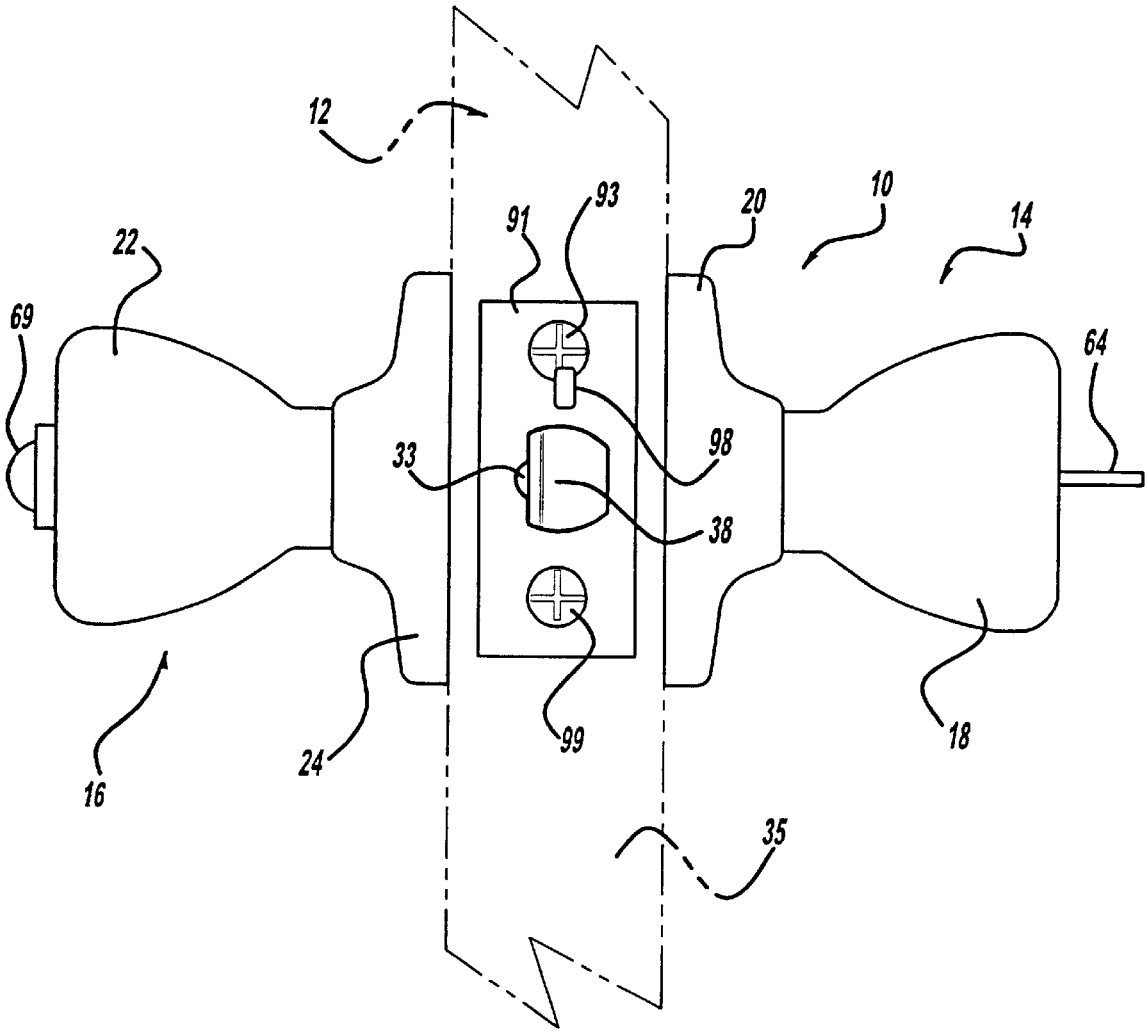
FIG. 10 is an end view of the door latch assembly taken generally in the direction of the Arrow 10 in FIG. 1 but with the opposite door knob apparatus shown in solid lines and also showing the location of the reed switch used to detect a locked or unlocked condition.

Looking now to FIGS. 8 and 11, a reed switch 98 or other type of magnetic detector is located in the door jamb 36 at a position proximate to the nose portion 38 of the latch bolt 32 when it is in the door jamb opening 34 when the door 12 is closed.

The reed switch 98 then is located in the path of the magnetic field between the nose portion 38 of the latch bolt 32 and the connecting bolt 93. The magnetic field is generally shown by the dashed lines in FIG. 11. Thus when the door latch assembly 10 is placed in the locked position the magnet 84 is moved into proximity between the ridge 94 of drive plate 42 and upper connecting bolt 93 thereby magnetically energizing the magnetic path noted which then will be detected by the reed switch 98. The reed switch 98 can be connected by conductors 100 and 102 to a signal, alarm, and/or surveillance system to provide an indication, signal or alarm as to the locked or unlocked condition of the door 12. Such signal, alarm and/or surveillance systems are well known in the art and hence the details of such system have been omitted for purposes of simplicity and brevity.

Thus the lock detection system of the present invention will provide a locked condition signal only when the door 12 is closed and the latch bolt 32 is located in the door jamb opening 34 with the lock actuated.

It should be noted that the features of the present invention could be utilized with other non-contact type detectors and energy generators. In this regard it should also be noted that while the door latch assembly 10 is shown to be actuated by doorknobs 18 and 22, handle type actuators could be used. Also while a key actuated lock is shown and described, as previously noted, other types of lock actuation could be employed, such as lever, push button, etc.

Also while actuation of the magnetic circuit is done by pivotal action such as by the actuating arm 80, actuation could be done by translational movement. In this regard, actuation could be provided by a movable magnetic transmitter with the magnet held stationary.

In addition, while detection of the locked condition is done by pivotal movement of the permanent magnet 84 into a position to activate the magnetic circuit it should be understood that the magnet 84 could be fixed and a magnetic insulator and conductor or shunt could be alternatively located in the circuit relative to the magnet 84 to open or close the magnetic circuit.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A lock sensor detection system for sensing the locked or unlocked condition of a door latch assembly with the door latch assembly adapted to be located in a door and having a latch bolt actuable between extended and retracted positions and operative with a door jamb in its extended position for engagement with the door jamb for normally maintaining the door in a closed, unlocked condition and with the door latch assembly including opening means for manually moving the latch bolt between the extended and retracted positions for opening and closing the door and including lock means selectively actuable to a locked condition for preventing actuation of the opening means to move the latch bolt to its retracted position away from the door jamb to prevent opening of the door, the lock sensor detection system comprising:

detection means operatively connected with said door latch assembly, said detection means comprising a magnetic circuit, and a permanent magnet member, operative means connected to said lock means for moving said magnet into said magnetic circuit in response to actuation of said lock means to the locked condition for providing a magnetic field in said magnetic circuit and for moving said magnet out of said magnetic circuit in response to actuation of said lock means to the unlocked condition, said magnetic circuit including said latch bolt, said detection means further including magnetic signal means located in said magnetic circuit in a position in the door jamb to be proximate to the latch bolt when located in the door jamb, said signal means providing a signal in response to the magnetic field in said magnetic circuit generated by said magnet when moved into said magnetic circuit in response to actuation of said lock means to the locked condition with the latch bolt in the door jamb.

2. The lock sensor detection system of claim 1 with said operative means including an actuating arm with said magnet member secured to said actuating arm, said operative means including a pivot structure for pivotally securing said actuating arm at a preselected position relative to said magnetic circuit and further including bias means for resiliently biasing said actuating arm to locate said magnet to a position out of said magnetic circuit.

3. The lock sensor detection system of claim 1 with said operative means including an actuating arm with said magnet member secured to said actuating arm, said operative means including a pivot structure for pivotally securing said actuating arm at a preselected position relative to said magnetic circuit and further including bias means for resiliently biasing said actuating arm to locate said magnet to a position out of said magnetic circuit, said actuating arm having an engagement arm portion located proximate to said lock means and adapted to be moved upon actuation of said lock means to pivot said actuating arm to move said magnet to a position in said magnetic circuit to provide the magnetic field in said magnetic circuit to activate said signal means.

4. The lock sensor detection system of claim 1 with said latch bolt including a nose portion adapted to be selectively moved into and out of the door jamb for closing and opening the door, said latch bolt further including an extension plate connected at the inner end of said latch bolt, said door latch assembly further comprising a drive plate operatively connected to said extension plate for moving said latch bolt between its opened and closed positions in response to actuation of said opening means, said drive plate being in generally sliding engagement with said extension plate with said extension plate slidable to permit said nose position to be moved to its retracted position independently of said opening means to permit door closure without actuation of said opening means, said magnetic circuit including said drive plate.

5. The lock sensor detection system of claim 1 with said latch bolt including a nose portion adapted to be selectively moved into and out of the door jamb for closing and opening the door, said latch bolt further including an extension plate connected at the inner end of said latch bolt, said door latch assembly further comprising a drive plate operatively connected to said extension plate for moving said latch bolt between its opened and closed positions in response to actuation of said opening means, said drive plate being in generally sliding engagement with said extension plate with said extension plate slidable to permit said nose position to be moved to its retracted position independently of said opening means to permit door closure without actuation of said opening means, said magnetic circuit including said drive plate, said operative means including an actuating arm with said magnet member secured to said actuating arm, said operative means including a pivot structure for pivotally securing said actuating arm at a preselected position relative to said magnetic circuit and further including bias means for resiliently biasing said actuating arm to locate said magnet to a position out of said magnetic circuit.

6. The lock sensor detection system of claim 5 with said actuating arm having an engagement arm portion located proximate to said lock means and adapted to be moved upon actuation of said lock means to pivot said actuating arm to move said magnet to a position in said magnetic circuit in line with said drive plate to provide the magnetic field in said magnetic circuit to activate said signal means.

7. In combination, a door latch assembly adapted to be located in a door and a lock sensor detection system for sensing the locked or unlocked condition of said door latch assembly the improvement comprising:

said door latch assembly having a latch bolt actuable between extended and retracted positions and operative with a door jamb in its extended position for engagement with the door jamb for normally maintaining the door in a closed, unlocked condition and with said door latch assembly including opening means for manually moving said latch bolt between the extended and retracted positions for opening and closing the door, said door latch assembly further including lock means selectively actuable to a locked condition for preventing actuation of the opening means to move said latch bolt to its retracted position away from the door jamb to prevent opening of the door, said lock sensor detection system including detection means operatively connected with said door latch assembly, said detection means comprising a magnetic circuit and a permanent magnet member, operative means connected to said lock means for moving said magnet into said magnetic circuit in response to actuation of said lock means to the locked condition for providing a magnetic field in said magnetic circuit and for moving said magnet out of said magnetic circuit in response to actuation of said lock means to the unlocked condition, said detection means further including magnetic signal means located in a position in the door jamb to be in said magnetic circuit and for providing a signal upon actuation of said lock means to the locked condition and in response to said magnetic field generated by said magnet with said latch bolt located in the door jamb.

8. A lock sensor detection system for sensing the locked or unlocked condition of a door latch assembly with the door latch assembly adapted to be located in a door and having a latch bolt actuable between extended and retracted positions and operative with a door jamb in its extended position for engagement with the door jamb for normally maintaining the door in a closed, unlocked condition and with the door latch assembly including opening means for manually moving the latch bolt between the extended and retracted positions for opening and closing the door and including lock means selectively actuable to a locked condition for preventing actuation of the opening means to move the latch bolt to its retracted position away from the door jamb to prevent opening of the door, the lock sensor detection system comprising:

detection means operatively connected with said door latch assembly, said detection means comprising a magnetic circuit, and a magnetic member for providing a magnetic field, operative means connected to said lock means for selectively connecting said magnetic member magnetically with said magnetic circuit in response to actuation of said lock means to the locked condition for communicating said magnetic field in said magnetic circuit and for selectively disconnecting said magnetic member out of communication with said magnetic circuit in response to actuation of said lock means to the unlocked condition, said detection means further including magnetic signal means located in said magnetic circuit in a position in the door jamb, said signal means providing a signal in response to the magnetic field in said magnetic circuit generated by said magnetic member when magnetically connected with said magnetic circuit in response to actuation of said lock means to the locked condition with the latch bolt in the door jamb.

9. In combination, a door latch assembly adapted to be located in a door and a lock sensor detection system for sensing the locked or unlocked condition of said door latch assembly the improvement comprising:

said door latch assembly having a latch bolt actuable between extended and retracted positions and operative with a door jamb in its extended position for engagement with the door jamb for normally maintaining the door in a closed, unlocked condition and with said door latch assembly including opening means for manually moving said latch bolt between the extended and retracted positions for opening and closing the; door, said door latch assembly further including lock means selectively actuable to a locked condition for preventing actuation of the opening means to move said latch bolt to its retracted position away from the door jamb to prevent opening of the door, said lock sensor detection system including detection means operatively connected with said door latch assembly, said detection means comprising a magnetic circuit and a magnetic member for providing a magnetic field, operative means connected to said lock means for selectively connecting said magnetic member magnetically with said magnetic circuit in response to actuation of said lock means to the locked condition for communicating said magnetic field with said magnetic circuit and for selectively disconnecting said magnetic member out of communication with said magnetic circuit in response to actuation of said lock means to the unlocked condition, said magnetic circuit including said latch bolt, said detection means further including magnetic signal means located in a position in the door jamb to be in said magnetic circuit and proximate to said latch bolt when located in the door jamb and for providing a signal upon actuation of said lock means to the locked condition and in response to said magnetic field generated by said magnetic member with said latch bolt located in the door jamb.

10. The lock sensor detection system of claim 9 with said operative means including an actuating arm with said magnet member being operatively associated with said actuating arm, said operative means including a pivot structure for pivotally securing said actuating arm at preselected positions relative to said magnetic circuit and further including bias means for resiliently biasing said actuating arm to place said magnet in a condition out of communication with said magnetic circuit.

11. The lock sensor detection system of claim 9 with said operative means including an actuating arm with said magnet member being operatively associated with said actuating arm, said operative means including a pivot structure for pivotally securing said actuating arm at preselected position relative to said magnetic circuit and further including bias means for resiliently biasing said actuating arm to place said magnet in a condition out of communication with said magnetic circuit, said actuating arm having an engagement arm portion located proximate to said lock means and adapted to be moved upon actuation of said lock means to pivot said actuating arm to place said magnet in a condition in said magnetic circuit to provide the magnetic field in said magnetic circuit to activate said signal means.

12. The lock sensor detection system of claim 9 with said latch bolt including a nose portion adapted to be selectively moved into and out of the door jamb for closing and opening the door, said latch bolt further including an extension plate connected at the inner end of said latch bolt, said door latch assembly further comprising a drive plate operatively connected to said extension plate for moving said latch bolt between its opened and closed positions in response to actuation of said opening means, said drive plate being in generally sliding engagement with said extension plate with said extension plate slidable to permit said nose portion to be moved to its retracted position independently of said opening means to permit door closure without actuation of said opening means, said magnetic circuit including said drive plate.

13. The lock sensor detection system of claim 9 with said latch bolt including a nose portion adapted to be selectively moved into and out of the door jamb for closing and opening the door, said latch bolt further including an extension plate connected at the inner end of said latch bolt, said door latch assembly further comprising a drive plate operatively connected to said extension plate for moving said latch bolt between its opened and closed positions in response to actuation of said opening means, said drive plate being in generally sliding engagement with said extension plate with said extension plate slidable to permit said nose portion to be moved to its retracted position independently of said opening means to permit door closure without actuation of said opening means, said magnetic circuit including said drive plate, said operative means including an actuating arm with said magnet member being operatively associated with said actuating arm, said operative means including a pivot structure for pivotally securing said actuating arm at preselected positions relative to said magnetic circuit and further including bias means for resiliently biasing said actuating arm to place said magnet in a condition out of communication with said magnetic circuit.

14. The lock detection system of claim 13 with said actuating arm having an engagement arm portion located proximate to said lock means and to be moved upon actuation of said lock means to pivot said actuating arm to place said magnet in a condition with said magnetic circuit to provide the magnetic field in said magnetic circuit to activate said signal means.

15. A lock sensor detection system for sensing the locked or unlocked condition of a door latch assembly with the door latch assembly adapted to be located in a door and having a latch bolt actuable between extended and retracted positions and operative with a door jamb in its extended position for engagement with the door jamb for normally maintaining the door in a closed, unlocked condition and with the door latch assembly including opening means for manually moving the latch bolt between the extended and retracted positions for opening and closing the door and including lock means selectively actuable to a locked condition for preventing actuation of the opening means to move the latch bolt to its retracted position away from the door jamb to prevent opening of the door, the lock sensor detection system comprising:

detection means operatively connected with said door latch assembly, said detection means comprising an energy transmission circuit, and energy source means for providing a source of transmittable energy, operative means connected to said lock means for selectively connecting said energy source means into said energy transmission circuit in response to actuation of said lock means to the locked condition for communicating said transmittable energy with said energy transmission circuit and for disconnecting said transmittable energy from said energy transmission circuit in response to actuation of said lock means to the unlocked condition, said detection means further including energy signal means located in said energy transmission circuit in a position in the door jamb, said signal means providing a signal in response to said transmittable energy in said energy transmission circuit generated by said energy source when connected with said energy transmission circuit in response to actuation of said lock means to the locked condition with the latch bolt in the door jamb.

16. In combination, a door latch assembly adapted to be located in a door and a lock sensor detection system for sensing the locked or unlocked condition of said door latch assembly the improvement comprising:

said door latch assembly having a latch bolt actuable between extended and retracted positions and operative with a door jamb in its extended position for engagement with the door jamb for normally maintaining the door in a closed, unlocked condition and with said door latch assembly including opening means for manually moving said latch bolt between the extended and retracted positions for opening and closing the door, said door latch assembly further including lock means selectively actuable to a locked condition for preventing actuation of the opening means to move said latch bolt to its retracted position away from the door jamb to prevent opening of the door, said lock sensor detection system including detection means operatively connected with said door latch assembly, said detection means comprising an energy transmission circuit and energy source means for providing a source of transmittable energy, operative means connected to said lock means for selectively connecting said energy source means into said energy transmission circuit in response to actuation of said lock means to the locked condition for communicating said transmittable energy with said energy transmission circuit and for disconnecting said transmittable energy from said energy transmission circuit in response to actuation of said lock means to the unlocked condition, said energy transmission circuit including said latch bolt, said detection means further including energy signal means located in a position in the door jamb to be in said energy transmission circuit and proximate to said latch bolt when located in the door jamb and for providing a signal upon actuation of said lock means to the locked condition and in response to said transmittable energy from said energy source means with said latch bolt located in the door jamb.

17. The lock sensor detection system of claim 16 with said energy source means comprising a magnetic member with said transmittable energy being a magnetic field provided by said magnetic member and with said energy transmission circuit being a magnetic circuit and with said signal means providing said signal in response to the magnetic field in said magnetic circuit generated by said magnetic member.

* * * * *